US005450808A

United States Patent [19]

Beagan

[11] Patent Number: 5,450,808

[45] Date of Patent: Sep. 19, 1995

[54] DEVICE TO SECURE A VESSEL AT A FIXED DISTANCE FROM A DOCK

[76] Inventor: James L. Beagan, 860 Banks Rd., Coconut Creek, Fla. 33063

[21] Appl. No.: 293,556

[22] Filed: Aug. 22, 1994

[51] Int. Cl.[6] ..... B63B 21/00

[52] U.S. Cl. ..... 114/230

[58] Field of Search ..... 114/249, 250, 230, 215, 114/216, 219; 280/493, 494; 267/20, 69, 289, 290, 291; 403/58

[56] References Cited

U.S. PATENT DOCUMENTS

| | | | |
|---|---|---|---|
| 973,906 | 10/1910 | Askegren | 114/250 |
| 996,997 | 7/1911 | Morris | 267/289 |
| 2,811,349 | 10/1957 | Bondurant et al. | 403/58 |
| 2,912,953 | 11/1959 | Olsen | 114/230 |
| 3,950,941 | 4/1976 | Ohrn | 403/58 |
| 4,144,831 | 3/1979 | Heydolph | 114/230 |
| 4,627,375 | 12/1986 | Davis et al. | 114/230 |
| 4,913,078 | 4/1990 | Haverly | 114/221 R |
| 5,014,638 | 5/1991 | Ilves et al. | 114/230 |
| 5,243,926 | 9/1993 | Wright et al. | 14/230 |

FOREIGN PATENT DOCUMENTS

| | | | |
|---|---|---|---|
| 125931 | 7/1919 | United Kingdom | 114/250 |

*Primary Examiner*—Edwin L. Swinehart
*Attorney, Agent, or Firm*—Oltman and Flynn

[57] ABSTRACT

A device for mooring and attaching watercrafts such as sailboats, rowboats, speedboats and the like is disclosed. A preferred embodiment includes an outer cylinder fixably secured to an axial threaded rod through a central anchor. Opposing springs are positioned on opposite sides of the central anchor. The outer cylinder contains two inner tubes each having one end within the outer cylinder and the other end extending outside the outer cylinder. The exposed ends of the inner cylinders are attached by rotatable connectors to a watercraft and dock respectively. Each inner cylinder has their own inner spring which are positioned on extreme sides of fixed anchors within the inner cylinders. The threaded rod uses locker nuts and washers to hold all the components together by axially passing through all the springs, anchors and cylinders. During operation, the springs within the outer cylinder compress in equal increments towards one another and expand in equal increments when the water craft moves away from the dock. The springs within the inner cylinders compress equally and simultaneously when the watercraft continues to move away from the dock. Likewise, these springs return to their normal position when the watercraft moves back towards the dock. Various pivotable attachments allow the watercraft to move 45 degrees up and down and side by side depending upon drift, wave action and the like.

13 Claims, 6 Drawing Sheets

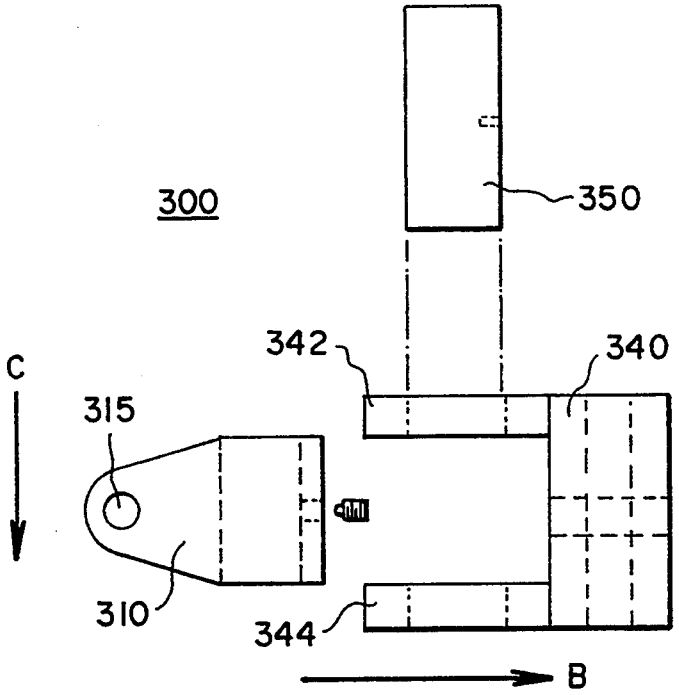
Fig. 7
Fig. 8
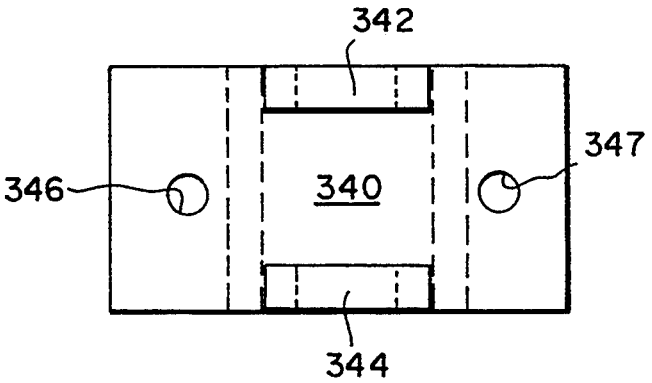
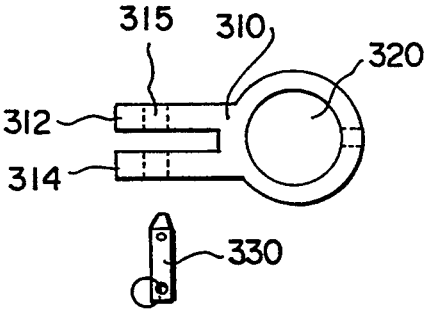
Fig. 10
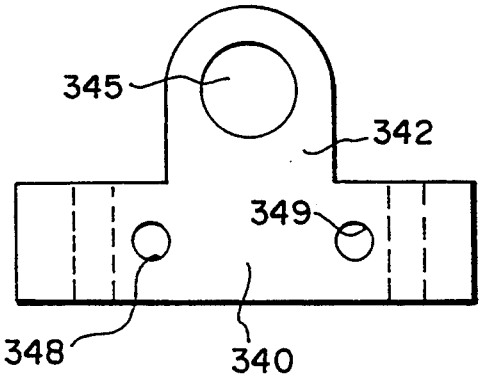
Fig. 9

350
400
410
412
414
415
420
430
442
444
448
440
441
210
D
452
450
455
458
461
462
464
500
447
446

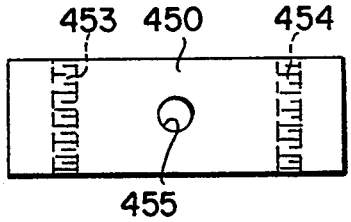
Fig. 14
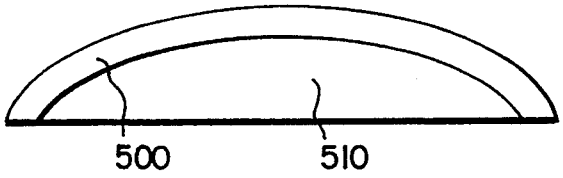
Fig. 15
Fig. 16
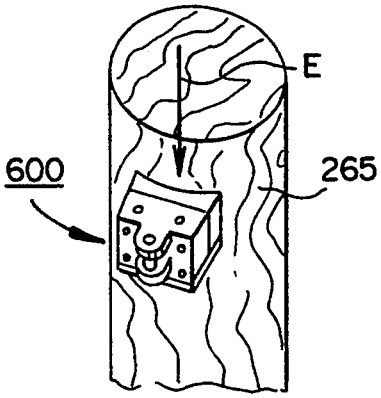
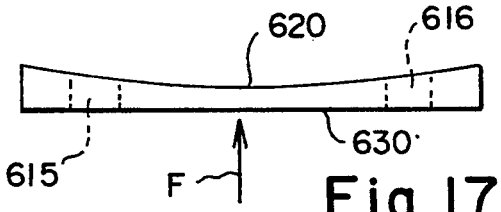
Fig. 17
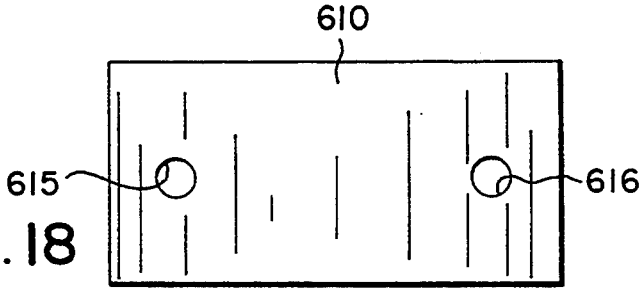
Fig. 18
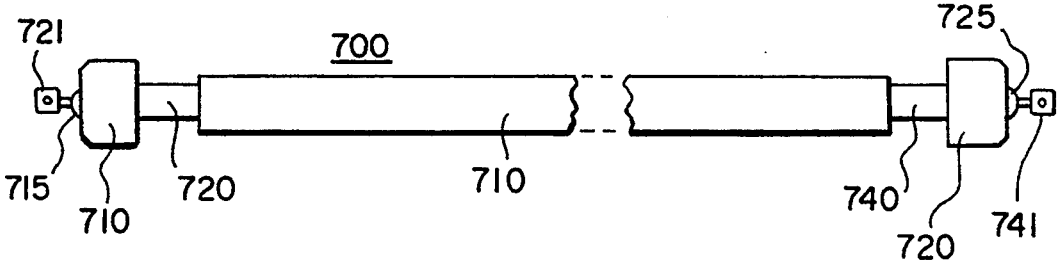
Fig. 19

DEVICE TO SECURE A VESSEL AT A FIXED DISTANCE FROM A DOCK

This invention relates to devices to anchoring and mooring devices for watercrafts, and in particular to an apparatus for securing a watercraft vessel at a fixed distance from a dock while allowing the vessel to generally rise and fall with the wave action while cushioning the severe effects of severe wave action.

BACKGROUND AND PRIOR ART

Many watercraft vessels such as power boats, sailboats and the like, often cannot be directly tied up against an intended dock because the draft of the vessel is too great and the sea floor immediately adjacent to the dock is too shallow. Likewise, rudders can cause similar problems in shallow areas immediately adjacent to the dock. Rudders extending outward from vessels can be damaged if the rudder hits against the dock during normal wave action. Also it is a known problem that the sides of vessels secured directly next to a dock tend to bounce against the dock and can potentially cause possible damage to either or both the vessel and the dock.

Past attempts to alleviate these problems have often been inadequate. For example, docks that are equipped with bumpers and fenders such as rubber strips and tires may eliminate some of the damage that can occur to a docked vessel. However, the bumpers and fenders on the dock can still chafe the sides of the vessels causing marks. Rigid mooring bars such as the one disclosed in U.S. Pat. No. 4,913,078 to Haverly, can secure a vessel a fixed distance from the dock. However, the vessel is then free to continuously bounce around with the normal wave action. The negatives of the Haverly device become evident when wave action becomes more extreme allowing the vessel to freely swing to crash up and down at the end of the mooring bar.

Thus, the need exists for a device to secure a vessel at a fixed distance from a dock while allowing the vessel to generally rise and fall with the wave action while cushioning the severe effects of severe wave action.

SUMMARY OF THE INVENTION

The first objective of the present invention is to provide an apparatus for fixedly securing a watercraft vessel a fixed distance from a dock.

The second object of this invention is to provide a device for attaching a watercraft vessel at a selected distance from the dock while cushioning the effects of wave action on the vessel.

The third object of this invention is to provide a device for mooring and anchoring watercraft vessel to a dock which will allow passengers to immediately step onto the dock.

The fourth object of this invention is to provide, an apparatus for docking a watercraft to a dock that eliminates chafing marks on the watercraft.

In a preferred embodiment an outer cylinder is fixably secured to an axial threaded rod through a central anchor. Opposing springs can be positioned on opposite sides of the central anchor. The outer cylinder contains two inner tubes each having one end within the outer cylinder and the other end extending outside the outer cylinder. The exposed ends of the inner cylinders are attached by rotatable connectors to a watercraft and dock respectively. Each inner cylinder has their own inner spring which are positioned on extreme sides of fixed anchors within the inner cylinders. The threaded rod uses locker nuts and washers to hold all the components together by axially passing through all the springs, anchors and cylinders. During operation, the springs within the outer cylinder compress in equal increments towards one another and expand in equal increments when the water craft moves away from the dock. The springs within the inner cylinders compress equally and simultaneously when the watercraft continues to move away from the dock. Likewise, these springs return to their normal position when the watercraft moves back towards the dock. Various pivotable attachments allow the watercraft to move 45 degrees up and down and side by side depending upon drift, wave action and the like.

Further objects and advantages of this invention will be apparent from the following detailed description of a presently preferred embodiment which is illustrated schematically in the accompanying drawings.

BRIEF DESCRIPTION OF THE FIGURES

FIG. 7 shows an exploded side view of the deck attachment connectors along arrow A of FIG. 6.

FIG. 8 shows a view of the deck connector portion of FIG. 7 along arrow B.

FIG. 9 shows a top view of the deck connector portion of FIG. 8.

FIG. 10 shows a top view of the mooring connector portion of FIG. 7 along arrow C.

FIG. 14 shows a view of the rear cleat connector portion of FIG. 11 along arrow D.

FIG. 15 shows a view of the cleat in FIG. 11 along arrow D.

FIG. 16 shows a front view of an alternative deck attachment connector for a deck post.

FIG. 17 shows a top view of the post adapter backing of FIG. 16 along arrow E.

FIG. 18 shows a view of the post adapter of FIG. 17 along arrow F.

FIG. 19 shows a side view of an alternative mooring device with ball and socket end connectors.

DESCRIPTION OF THE PREFERRED EMBODIMENT

Before explaining the disclosed embodiment of the present invention in detail it is to be understood that the invention is not limited in its application to the details of the particular arrangement shown since the invention is capable of other embodiments. Also, the terminology used herein is for the purpose of description and not of limitation.

Figure 1:
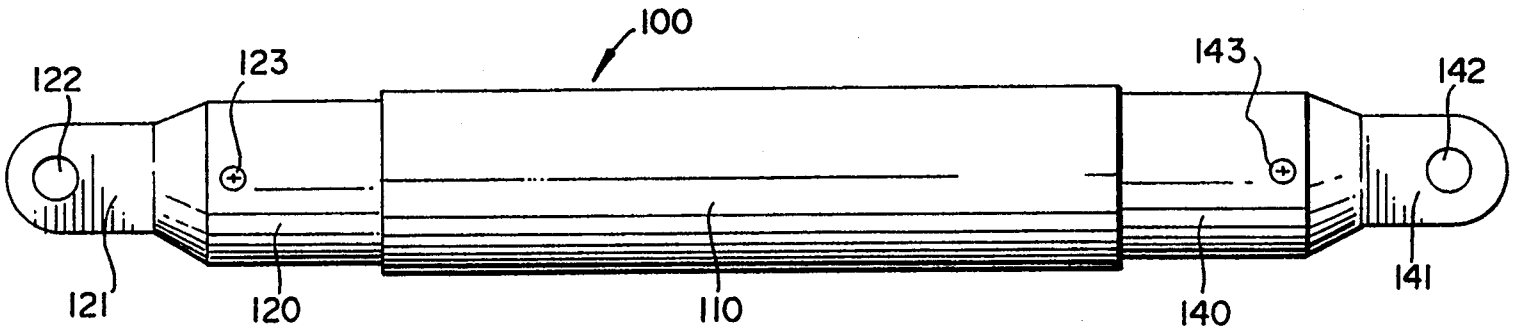
FIG. 1 shows an exterior side view of the mooring invention device.

FIG. 1 shows an exterior side view of the mooring invention device 100, the components of which will now be described. Mooring device 100 includes an outer cylinder 110 approximately 21.5 inches in length with a diameter of approximately 2.5 inch outer diameter with walls approximately 3/16 inch thick. Extending outside opposing ends of outer cylinder 110 is a left spring biased hollow cylinder guide 120 which is connected to a loop connector by a screw 123 or the like. On the opposite side of outer cylinder 110 is a right spring biased hollow cylinder guide 140 which is connected to a loop connector 141 by a screw 143. Loops 121 and 141 are used for attachment to a watercraft and dock respectively which will be discussed later. Inner cylinders 120 and 140 are each approximately 12.5 inches in length with an outside diameter of 1.25 inches. Device 100 is approximately 31 inches in length end to end when assembled. Loops 121 and 141 each extend out from their respective inner cylinder guides approximately one inch each. The material used to form the outer cylinder and inner cylinder guides, and loops can be selected from but not limited to fiberglass, stainless steel, aluminum and the like.

Figure 2:
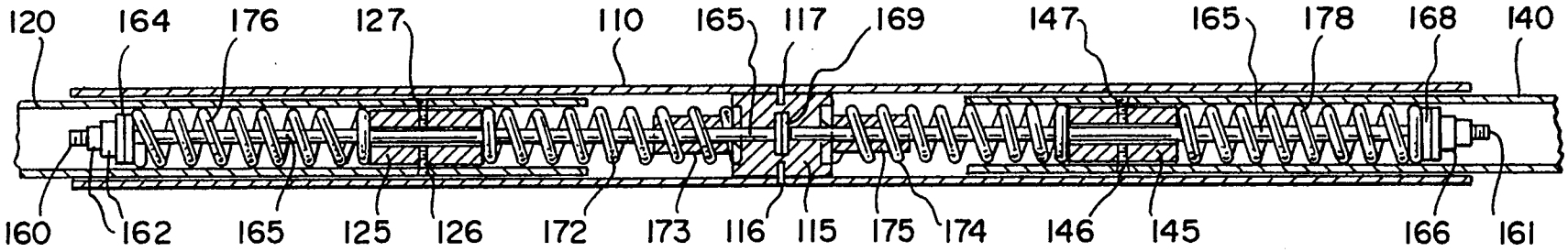
FIG. 2 shows a cutaway view of the device of FIG. 1.

The interior components of mooring device 100 will now be discussed in reference to FIG. 2, which shows a cutaway cross sectional view of the device 100 of FIG. 1. Within outer cylinder 110 is an anchor plug 115 formed of solid steel, iron or the like, which fixably holds a rod 165 in place by being soldered or welded by to a washer 169 or the like. Anchor plug 115 is fixably secured to outer cylinder 110 by screws 116, 117 and the like. On the left of anchor plug 115 is a first spring 172 aligned and centered about rod 165 by a sleeve 173. On the right side of anchor plug 115 is a second spring 174 aligned and centered about rod 165 by a sleeve 175.

Referring again to FIG. 2, to the left of spring 172 is a first inner anchor plug 125 which can freely move about relative to rod 165. Anchor plug 125 is fixably secured to first inner cylinder 120 by screws 126, 127 and the like. To the left of anchor plug 125 is a third spring 176 which is freely supported to move about rod 165 when device 100 is not being used. A locking nut(s) 162 screws on threads 160 at the left end of rod 165 to hold washer(s) against one side of third spring 176.

Referring again to FIG. 2, to right of second spring 174 is a second inner anchor 145 which can freely move about relative to rod 165. Anchor plug 145 is fixably secured to second inner cylinder 140 by screws 146, 147 and the like. To the right of anchor plug 145 is a fourth spring 178 which is freely supported to move about rod 165 when device 100 is not being used. A locking nut(s) 166 screws on threads 161 at the right end of rod 165 to hold washer(s) against one side of fourth spring 178. The components other than the cylinders can be selected from materials such as but not limited to stainless steel, brass, plated metal, and the like.

Figure 3:
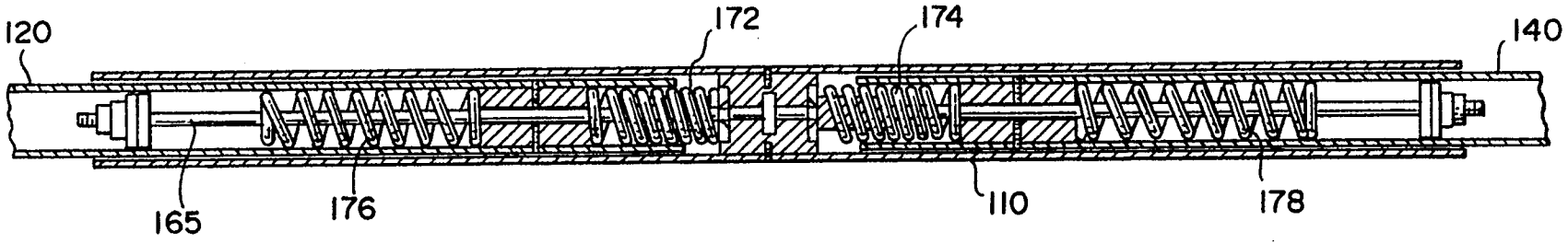
FIG. 3 shows the device of FIG. 1 in a compressed position.

The operation of the components in device 100 will now be discussed in relation to FIGS. 3 and 4. FIG. 5 which will be discussed later illustrates a watercraft such as a sailboat that can be moored and anchored to a dock by device 100 using the cleats on the sailboat. Referring to FIG. 3 which shows the device 100 of FIG. 1 in a compressed position when a watercraft moves in a direction towards a dock. First spring 172 and second spring 174 are compressed equally and simultaneously towards one another when the watercraft moves towards the dock. While compressing the inner cylinders 120 and 140 also move towards one another which in effect allows the watercraft to physically get closer to a dock.

Figure 4:
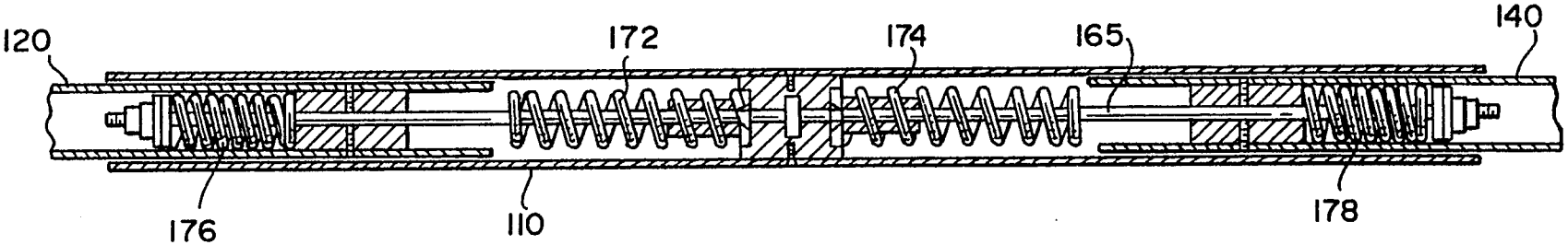
FIG. 4 shows the device of FIG. 1 in an extended and stretched position.
Figure 5:
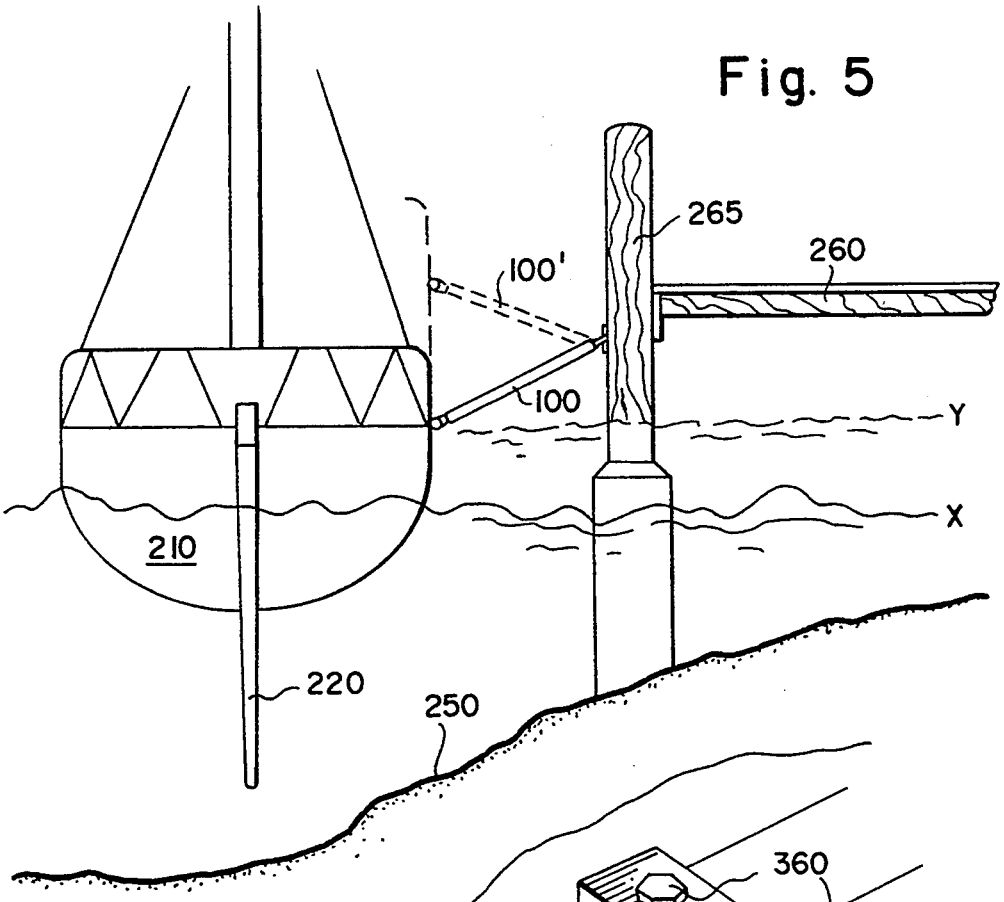
FIG. 5 shows the invention of FIG. 1 in a working application between a watercraft and a dock.

FIG. 4 shows the device 100 of FIG. 1 in an extended and stretched position. Here, first spring 172 and second spring 174 expand equally and simultaneously apart from one another when the watercraft moves away from the dock, and inner cylinders 120 and 140 move away from one another allowing the watercraft to physically move away from the dock.

FIG. 5 shows the invention mooring device 100 of FIG. 1 in a working application between a watercraft 210 such as a sailboat, and to a dock 265. From FIG. 5, it can visually be seen the necessity of positioning sailboat 210 due to the rudder 220 which can strike against the seafloor 250 if the sailboat 210 is allowed to become adjacent to dock 260. The positions 100 and 100' of the mooring device are meant to show the needed flexibility of allowing the mooring device 100 to be able to pivot at least 45 degrees upward during low tide X, and high tide, Y. Various attachment connectors for attaching mooring device 100 to both the watercraft 210 and to parts of dock 260 will be discussed next.

Figure 6:
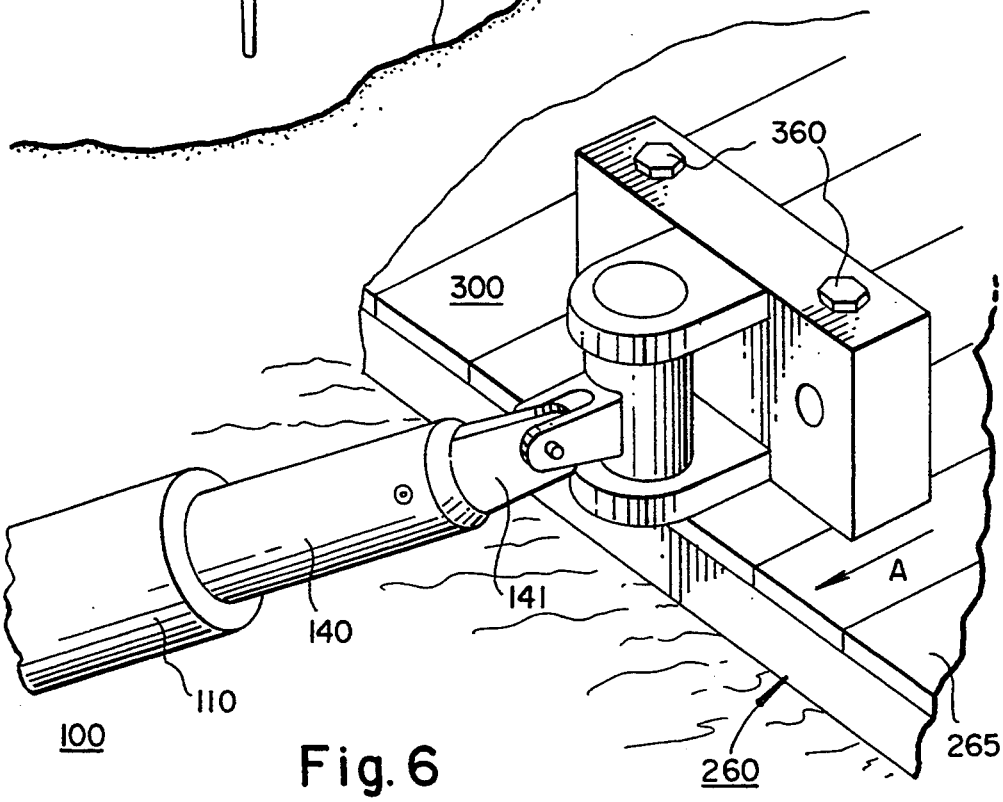
FIG. 6 shows an enlarged view of the one end of the mooring device of FIG. 1 attached to a deck through deck attachment connectors.

FIG. 6 shows an enlarged view of loop end 141 of the mooring device 100 of FIG. 1 attached to a deck surface 265 through deck attachment connectors 300. Here, mooring device 100 is free to rotatably move up and down and side to side, relative to the dock 260 because of the deck attachment connectors 300 which can be connected to dock 260 through fasteners 360 such as wood screws, bolts and the like.

FIG. 7 shows an exploded side view of the deck attachment connectors 300 along arrow A of FIG. 6. FIG. 8 shows a view of the deck connector portion 340 of FIG. 7 along arrow B. FIG. 9 shows a top view of the deck connector portion 340 of FIG. 8. FIG. 10 shows a top view of the mooring connector portion 310 of FIG. 7 along arrow C. Referring to FIGS. 7 to 10, pivoting U-shaped flange 310 includes a center hole 320 and a pin hole 315 through which a pin 330 is inserted to pivotally support loop hole 142 from mooring device 100 thereon. The U-shaped flange 310 is rotatably supported by bifurcated support bracket 340 by inserting guide post 350 into center guide holes 345 which are parallel and aligned to one another in fork teeth 342 and 344. The support bracket 340 can be fixed to a fleck by screwing fasteners such as bolts and the like through side-holes 346, 347 or alternatively in through-holes 348, 349.

Figures 11, 12, 13:
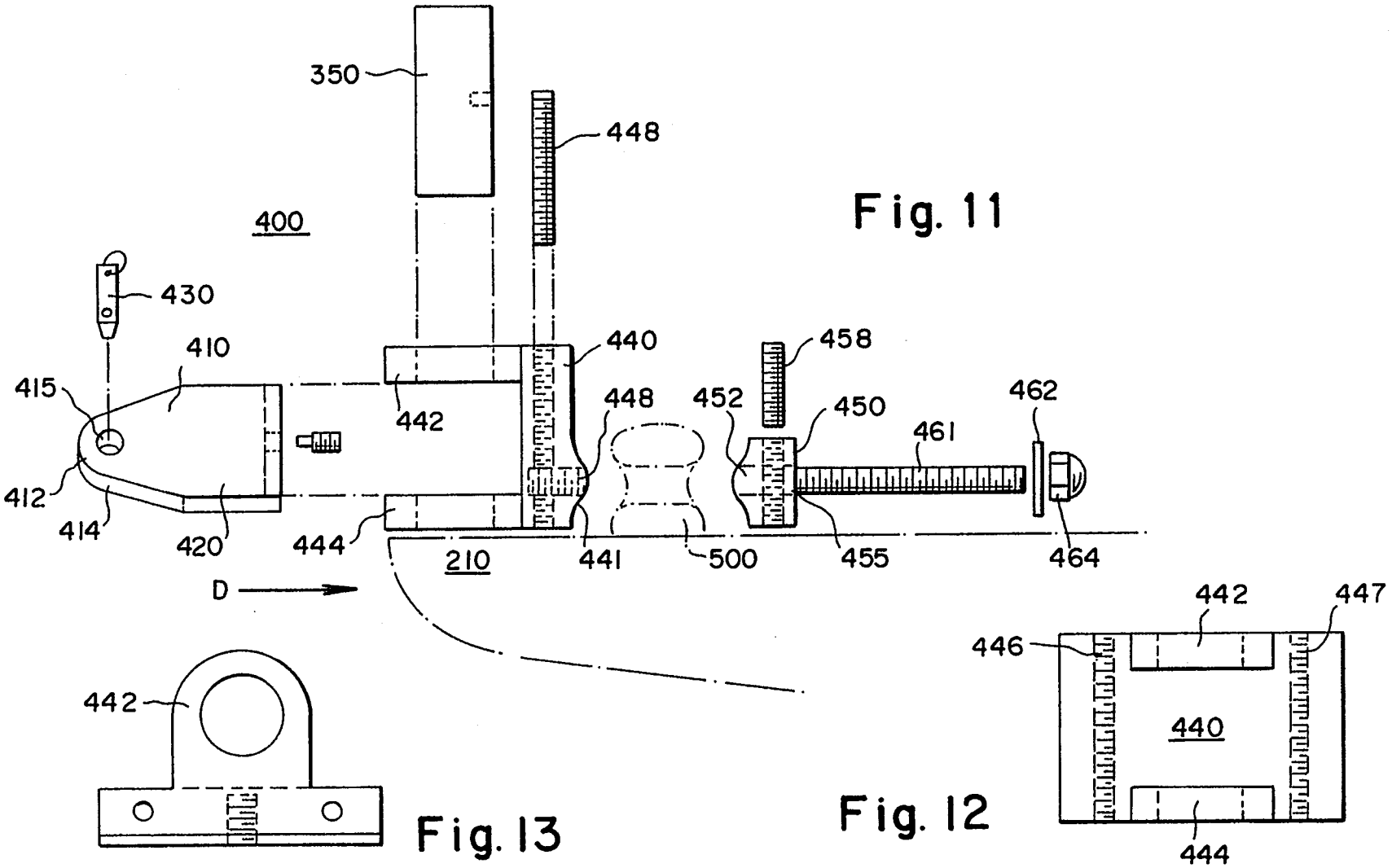
FIG. 11 shows an exploded side view of cleat attachment connectors for the device of FIG. 1.
FIG. 12 shows a view of front cleat connector portion of FIG. 11 along arrow D.
FIG. 13 shows a top view of the cleat connector portion of FIG. 12.

FIG. 11 shows an exploded side view of cleat attachment connectors 400 for the device 100 of FIG. 1. FIG. 12 shows a view of front cleat connector portion 440 of FIG. 11 along arrow D. FIG. 13 shows a top view of the cleat connector portion 440 of FIG. 12. FIG. 14 shows a view of the rear cleat connector portion 450 of FIG. 11 along arrow D. FIG. 15 shows a view of the cleat 500 in FIG. 11 along arrow D. Referring to FIGS. 11 through 15, pivoting U-shaped flange 410 similar to the flange 310 of FIG. 9, is pivotally attached to loop hole 122 of device 100 by inserting pin 430 through hole 415. Flange 410 is rotatably supported to bifurcated bracket 440 by inserting guide post 350 through fork teeth 442, 444. The back of bracket 440 has a curved backing for fitting through opening 510 of a standard type cleat 500 which is located on most watercrafts. The other side cleat 500 has an anchor plate 450 with a similar opposing curved face 452 to that on the support bracket 440. A threaded rod 461 is inserted through a horizontal hole 455 through another horizontal hole 448 of bracket 440. A locking nut 464 and washer 462 is tightened on the end threads of rod 461. Vertical fasteners 448, 458, such as wood screws, bolts and the like pass through vertical holes 446, 447, 453, 454 in bracket 440 and anchor plate 450 respectively to hole the cleat attachment connectors to the surface area on the watercraft 210.

FIG. 16 shows a front view of an alternative deck attachment connector 600 for a deck post/piling 265. FIG. 17 shows a top view of the post adapter backing 610 of FIG. 16 along arrow E. FIG. 18 shows a view of the post adapter 610 of FIG. 17 along arrow F. Curved backing 620 can be used to fit against a like curved side of deck post/piling 255. Backing 610 is sized to be able to fit on the rear side of the deck connector portion 340 of FIGS. 7, 8 and holes 346 and 347 can be aligned with like holes 615, 616 of backing 610.

FIG. 19 shows a side view of an alternative mooring device 700 with ball 715, 725 and socket end connectors 710, 720. Components 720, 721, 710, 740, 741 are identical to like components 121, 120, 110, 140 and 141 of FIG. 1.

While the watercraft mentioned above was listed as a sailboat, the invention would have equal applicability to other types of watercrafts such as but not limited to rowboats, speedboats, fishing boats, large and small watercrafts, and the like.

While the mooring device has been described as being connected to a cleat on a watercraft, it is noted that the mooring device invention can be attached to any of various cleats towards either or both the bow and stern of the watercraft depending on the docking to be desired.

Although the mooring device embodiment listed above includes dimensions and sizes for the components that make up the device, these sizes and dimensions can be adjusted accordingly based on the size and type of watercraft used, the desired distance between the watercraft and dock, as well as the cushion/spring action needed. Accordingly, the tensile strength of the inner springs can be chosen based on desired operating characteristics for the mooring devices.

While the invention has been described, disclosed, illustrated and shown in various terms of certain embodiments or modifications which it has presumed in practice, the scope of the invention is not intended to be, nor should it be deemed to be, limited thereby and such other modifications or embodiments as may be suggested by the teachings herein are particularly reserved especially as they fall within the breadth and scope of the claims here appended.

I claim:

1. A device for mooring and anchoring a watercraft to a dock comprising:

an outer tube having a first end and a second end;

a first inner cylinder spring biased to the outer tube, the first inner cylinder having a first end within the outer tube and a second end extending from the first end of the outer tube for attachment to a dock, the first inner cylinder includes:

first and second opposing springs, wherein compressing the first spring allows the second spring to not be compressed, and where compressing the second spring allows the first spring to not be compressed; and a second inner cylinder spring biased to the outer tube, the second inner cylinder having a first end within the outer tube and a second end extending from the second end of the outer tube for attachment to a watercraft.

2. The device for mooring and anchoring of claim 1, wherein the second inner cylinder includes:

third and fourth opposing springs, wherein compressing the third spring allows the fourth spring to not be compressed, and where compressing the fourth spring allows the third spring to not be compressed.

3. The device for mooring and anchoring of claim 1, wherein the outer cylinder includes:

a left inner spring and an opposing right inner spring, wherein the left and right springs are compressed equally and simultaneously when the water craft moves towards the dock, and wherein the left and right springs expand equally and simultaneously apart from one another when the watercraft moves away from the dock.

4. The apparatus of claim 1, wherein the first inner cylinder is attached to the dock by:

a set of flanges.

5. The apparatus of claim 1, wherein the second inner cylinder is attached to the watercraft by:

a set of flanges.

6. The apparatus of claim 1, wherein the first inner cylinder is attached to the dock by:

a first ball and socket connection.

7. The apparatus of claim 1, wherein the second inner cylinder is attached to the watercraft by:

a second ball and socket connection.

8. The apparatus of claim 1, wherein the first inner cylinder is attached to the dock by:

a first set of flanges, and the second inner cylinder is attached to the watercraft by:

a second set of flanges.

9. The apparatus of claim 1, wherein the first inner cylinder is attached to the dock by:

a first ball and socket connection, and the second inner cylinder is attached to the watercraft by:

a second ball and socket connection.

10. A device for mooring and anchoring a watercraft to a dock comprising:

an elongated cylinder having a first end positioned adjacent to a watercraft and a second end positioned adjacent to a dock, the elongated cylinder having a left inner spring and an opposing right inner spring, wherein the left and right springs are compressed equally and simultaneously when the watercraft moves towards the dock, and wherein the left and fight springs expand equally and simultaneously apart from one another when the watercraft moves away from the dock;

a first inner cylinder having a first end within the elongated cylinder and a second end extending from the first end of the outer tube for attachment to a watercraft, the first inner cylinder includes:

a first inner cylinder spring; and a second inner cylinder having a first end within the elongated cylinder and a second end extending from the second end of the outer tube for attachment to a dock, the second inner cylinder includes:

a second inner cylinder spring, wherein compressing the left and the right springs allows the first and the second inner springs to not be compressed,

11. The apparatus of claim 10, wherein the first inner cylinder is attached to the watercraft by:

a first set of flanges, and second inner cylinder is attached to the dock by: a second set of flanges.

12. The apparatus of claim 10, wherein the first inner cylinder is attached to the watercraft by:

a first ball and socket connection, and the second inner cylinder is attached to the dock by: a second ball and socket connection.

13. A device for mooring and anchoring a watercraft to a dock comprising:

an outer tube having a first end and a second end;

a first inner cylinder spring biased to the outer tube, the first inner cylinder having a first end within the outer tube and a second end extending from the first end of the outer tube for attachment to a dock, the first inner cylinder includes:

first and second opposing springs; and a second inner cylinder spring biased to the outer tube, the second inner cylinder having a first end within the outer tube and a second end extending from the second end of the outer tube for attachment to a watercraft, the second inner cylinder includes:

third and fourth opposing springs.

* * * * *